US010823352B2

(12) United States Patent
Yamamura et al.

(10) Patent No.: US 10,823,352 B2
(45) Date of Patent: Nov. 3, 2020

(54) VEHICLE HEADLIGHT WITH POLARIZED LIGHT GENERATOR

(71) Applicant: KOITO MANUFACTURING CO., LTD., Tokyo (JP)

(72) Inventors: Satoshi Yamamura, Shizuoka (JP); Kenta Mukojima, Shizuoka (JP); Yusuke Nakada, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/629,060

(22) PCT Filed: Jul. 6, 2018

(86) PCT No.: PCT/JP2018/025624
§ 371 (c)(1),
(2) Date: Jan. 7, 2020

(87) PCT Pub. No.: WO2019/013113
PCT Pub. Date: Jan. 17, 2019

(65) Prior Publication Data

US 2020/0191350 A1 Jun. 18, 2020

(30) Foreign Application Priority Data

Jul. 14, 2017 (JP) ..... 2017-137798

(51) Int. Cl.
*F21S 41/135* (2018.01)
*F21S 41/675* (2018.01)

(52) U.S. Cl.
CPC ..... *F21S 41/135* (2018.01); *F21S 41/675* (2018.01)

(58) Field of Classification Search
CPC ..... F21S 41/135; F21V 11/18; F21V 9/14; F21V 13/08; G03B 21/2073; G03B 21/604
See application file for complete search history.

(56) References Cited

U.S. PATENT DOCUMENTS

2003/0189839 A1 10/2003 Shikano
2013/0038736 A1 2/2013 Yamamura
(Continued)

FOREIGN PATENT DOCUMENTS

JP 2003-297116 A 10/2003
JP 2005-041443 A 2/2005
WO 2011/129105 A1 10/2011

OTHER PUBLICATIONS

English translation of the Written Opinion from the ISA for PCT/JP2018/025624 (Year: 2018).*
(Continued)

*Primary Examiner* — Sean P Gramling
*Assistant Examiner* — Keith G. Delahoussaye
(74) *Attorney, Agent, or Firm* — Pearne & Gordon LLP

(57) ABSTRACT

The present invention relates to a vehicle headlight that ensures maintaining usage efficiency of a light of the vehicle headlight while improving visibility of an irradiation target on a road by a headlight light from a host vehicle. A vehicle headlight 1 having a headlight unit 4 forming a light distribution pattern by projecting a light B1 from a light source 9 ahead includes a polarized light generator 8, a first headlight unit 5, and a second type headlight unit 6. The polarized light generator 8 generates a first and a second polarized lights (B11, B12) by the light B1 from the light source 9. The first headlight unit 5 indicates main light distribution patterns (La1, Lb1) by a first polarized light B11 ahead. The second type headlight unit 6 scans with a second polarized light B12 using a scanning mechanism 13, and
(Continued)

indicates ahead auxiliary light distribution patterns (La2, Lb2) irradiating a range narrower than the main light distribution patterns (La1, Lb1).

6 Claims, 6 Drawing Sheets

(56) References Cited

U.S. PATENT DOCUMENTS

| | | | | |
|---|---|---|---|---|
| 2016/0169469 | A1* | 6/2016 | Sugiyama | F21S 41/25<br>362/19 |
| 2020/0056755 | A1* | 2/2020 | Zhang | G02B 27/283 |

OTHER PUBLICATIONS

International Search Report dated Sep. 11, 2018 filed in PCT/JP2018/025624.

* cited by examiner

VEHICLE HEADLIGHT WITH POLARIZED LIGHT GENERATOR

TECHNICAL FIELD

The present invention relates to a vehicle headlight that causes a driver to view headlight lights of oncoming vehicles less easily, a reflected glare light due to a reflection from damp road surfaces, and the like, and improves visibility of irradiation targets on roads being irradiated with a headlight light of a host vehicle.

BACKGROUND ART

PATENT LITERATURE 1 discloses an anti-dazzle device used in a vehicle headlight. The anti-dazzle device allows a driver to easily view signs on wet road surfaces by irradiating the wet road surfaces ahead of a vehicle with a light and having the light transmitted through a polarizing glass that cuts only a predetermined reflected polarized light.

CITATION LIST

Patent Literature

Patent Literature 1: IP-A-2005-41443

SUMMARY OF THE INVENTION

Problems to be Solved by the Invention

The anti-dazzle device in PATENT LITERATURE 1 cuts off an unavailable polarized light component that interferes with view of road signs among reflected lights emitted from the vehicle headlight, reflected by the wet road surfaces, and headed for the driver. This reduces usage efficiency of the reflected light. Additionally, visibility of the reflected light irradiated on irradiation targets, such as the wet road surfaces, traffic signs, and oncoming vehicles, from the vehicle headlight, and headed for the driver is considered to differ depending on road surface conditions and the irradiation targets. Therefore, it is preferred to cause the driver to view the reflected light generated on the road surface conditions and the irradiation targets.

This application has been made in consideration of the above-described problem, and provides the vehicle headlight that ensures maintaining the usage efficiency of a the light from the vehicle headlight while improving the visibility of the irradiation targets on the roads irradiated with the headlight light of a host vehicle by causing a driver to view less easily the headlight lights of the oncoming vehicles and a reflected glare light due to a reflection from the damp road surfaces and the like.

SOLUTION TO THE PROBLEMS

Provided is a vehicle headlight having a headlight unit for projecting a light from a light source ahead to form a light distribution pattern. The vehicle headlight includes: a polarized light generator that generates a first and a second polarized lights by the light from the light source; a first headlight unit that indicates a main light distribution pattern by the first polarized light ahead; and a second headlight unit that scans with the second polarized light using a scanning mechanism and indicates an auxiliary light distribution pattern that irradiates a range narrower than the main light distribution pattern ahead.

(Operation) The auxiliary light distribution pattern by the second polarized light optimally generated according to road surface conditions, such as wet road surfaces, and difference in irradiation targets, such as traffic signs, spot-irradiates the wet road surfaces, the traffic signs, and the like. The first polarized light that is not used for the spot irradiation is irradiated as the main light distribution pattern that forms an entire shape of the light distribution pattern.

The vehicle headlight includes an output changer that increases and decreases an output of the second polarized light. The second polarized light is a combined light obtained by combining an S-polarized light emitted by the output changer and a P-polarized light emitted by the output changer.

(Operation) The second polarized light indicates the appropriate auxiliary light distribution pattern in accordance with the difference in environment, such as the headlight lights of the oncoming vehicles and a reflected glare light due to a reflection from the damp road surfaces, based on the individual outputs of the S-polarized light and the P-polarized With the vehicle headlight, the second headlight unit indicates the auxiliary light distribution pattern at a center of the main light distribution pattern.

(Operation) The second headlight unit reduces visibility of a glare light due to the headlight lights of the oncoming vehicles to the driver.

With the vehicle headlight, the second headlight unit indicates the auxiliary light distribution pattern near a lower end portion of the main light distribution pattern.

The second headlight unit reduces the visibility of the reflected glare light due to the reflection from the damp road surfaces to the driver.

EFFECTS OF THE INVENTION

The vehicle headlight allows maintaining usage efficiency of the light from the vehicle headlight, causing a driver to view less easily the headlight lights of the oncoming vehicles, the reflected glare light due to the reflection from the damp road surfaces, and the like, and improving the visibility of the irradiation targets on the roads irradiated with the headlight light of a host vehicle by the driver.

Additionally, the vehicle headlight effectively reduces the visibility of the glare light to the driver without being affected by the environmental change ahead of the vehicle, and can improve the visibility of every irradiation target to the driver.

Furthermore, the vehicle headlight causes the driver to feel less easily the brightness of the headlight lights of the oncoming vehicles to improve the visibility ahead of the vehicle.

The vehicle headlight also causes the driver to feel less easily brightness of the reflected glare light due to the reflection from the damp road surfaces to improve the visibility ahead of the vehicle.

BRIEF DESCRIPTION OF THE DRAWINGS

FIG. 4(*b*) is an explanatory diagram of a second light distribution pattern according to the first example.

DESCRIPTION OF THE EMBODIMENTS

The following describes preferred embodiments of the present invention based on FIG. 1 to FIG. 4. In each drawing, directions of respective units of a vehicle headlight and a road viewed from a driver of a vehicle to vehicle the vehicle headlight is mounted are described as (upper: lower: left: right: front: rear=Up: Lo: Le: Ri: Fr: Re).

Figure 1:
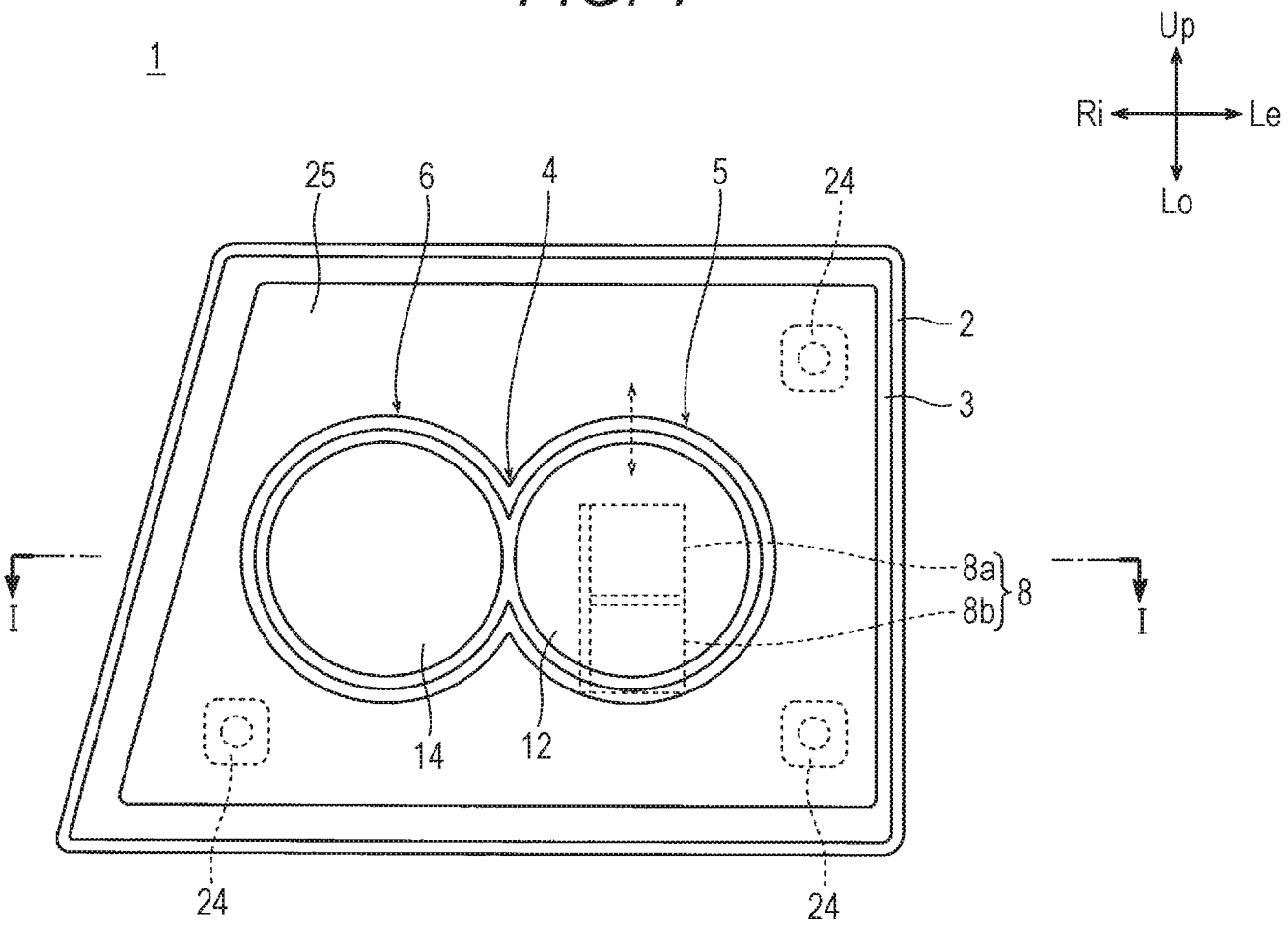
FIG. 1 is a front view of a vehicle headlight according to a first example.

According to FIG. 1 to FIG. 4, a vehicle headlight of a first example is described. A vehicle headlight 1 of the first example is an exemplary right headlight of a vehicle (not illustrated), and includes a lamp body 2, a front cover 3, and a headlight unit 4. The lamp body 2 has an opening on a front side of the vehicle. The front cover 3 is formed of a resin, a glass, and the like that have a translucency, and is installed to the opening of the lamp body 2 to form a lamp space S inside. The headlight unit 4 illustrated in FIG. 1 is positioned inside the lamp space S with a metallic supporting member 7.

Figure 2:
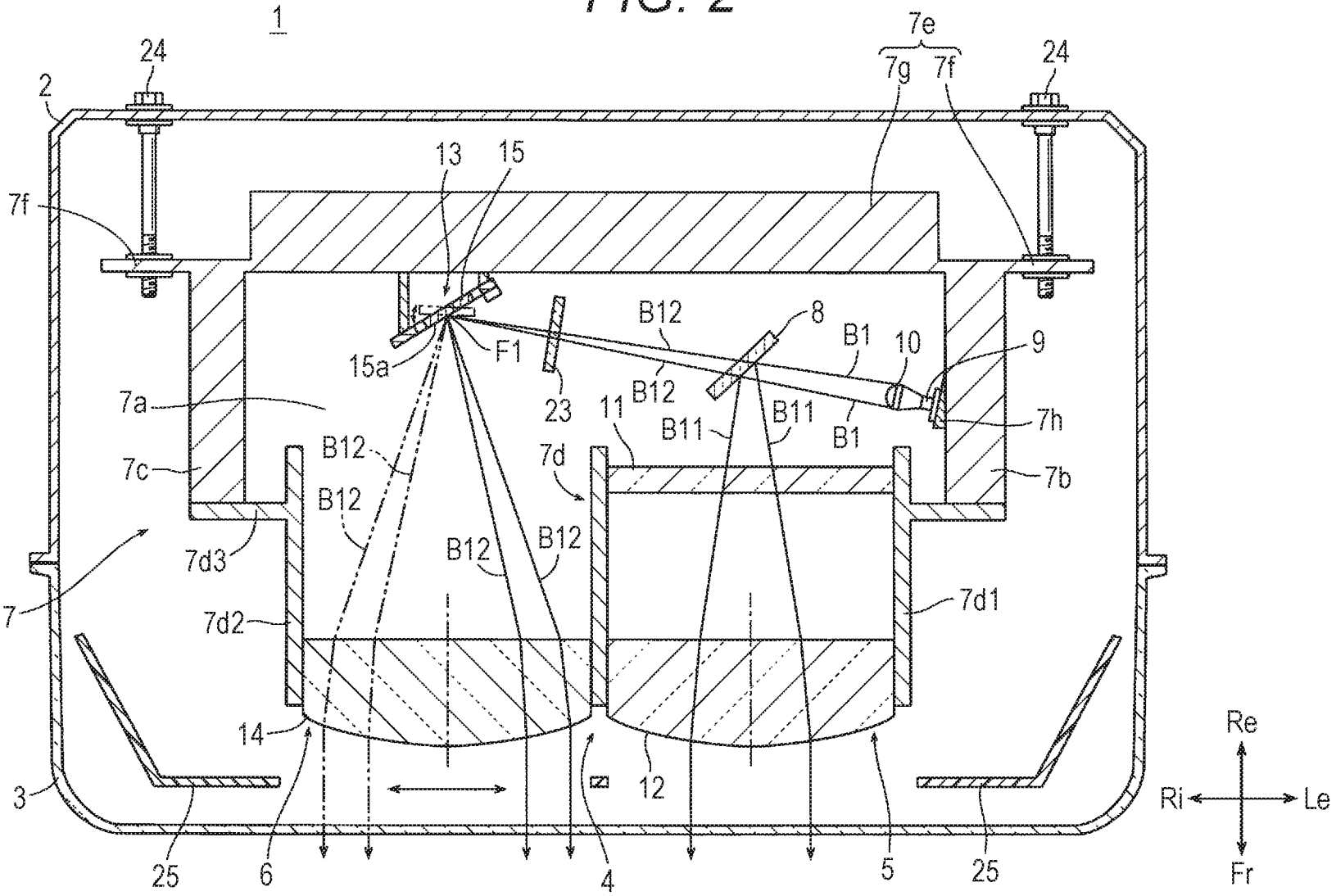
FIG. 2 is a I-I cross-sectional view taken along a lateral direction of the vehicle headlight of the first example.

The headlight unit 4 in FIG. 1 and FIG. 2 has each of a first headlight unit 5, a second headlight unit 6, a polarized light generator 8 as a reflection type polarizing plate, a light source 9 by a light-emitting element, such as an LED, a condenser lens 10, and a shutter 23. These are all installed to the supporting member 7.

The first headlight unit 5 in FIG. 2(*a*) has a liquid crystal panel 11 and a first projection lens 12, and the second headlight unit 6 has a scanning mechanism 13 and a second projection lens 14. The first projection lens 12 and the second projection lens 14 are transparent or semitransparent plano-convex lenses with light-emitting surfaces having convex shapes.

The supporting member 7 is formed of metal, and has a bottom plate portion 7*a*, side plate portions (7*b*, 7*c*), a lens supporting portion 7*d*, and a base plate portion 7*e*. The side plate portions (7*b*, 7*c*) are respectively integrated with right and left end portions of the bottom plate portion 7*a*. The lens supporting portion 7*d* is integrated with distal ends of the side plate portions (7*b*, 7*c*). The base plate portion 7*e* is integrated with base ends of the side plate portion (7*b*, 7*c*). The lens supporting portion 7*d* includes a first cylinder portion 7*d*1, a second cylinder portion 7*d*2, and a flange portion 7*d*3. The first cylinder portion 7*d*1 on a left side and the second cylinder portion 7*d*2 on a right side are integrated. The first cylinder portion 7*d*1 holds the liquid crystal panel 11 inside near a base end portion, and has the first projection lens 12 fixed inside near a distal end portion, with its convex surface facing forward. The second cylinder portion 7*d*2 has the second projection lens 14 fixed inside near the distal end portion, with its convex surface facing forward. The flange portion 7*d*3 is integrally formed on an outer periphery of the first cylinder portion 7*d*1 and the second cylinder portion 7*d*2, and is integrated with both of the side plate portions (7*b*, 7*c*). The base plate portion 7*e* includes a screw fixing portion 7*f*, and a heat dissipation portion 7*g* that has a front-to-rear depth greater than the screw fixing portion 7*f*.

The light source 9 in FIG. 2 includes an LED light source or a laser light source, and is fixed to a light source supporting portion 7h disposed on the side plate portion 7*b* on the left side of the supporting member 7 to dissipate heat during lighting. The scanning mechanism 13 is a scanning device that has a reflecting mirror 15 tiltable in a biaxial direction. The scanning mechanism 13 is fixed to a front face of the heat dissipation portion 7*g* of the supporting member 7 so that a reflecting surface 15*a* of the reflecting mirror 15 is opposed to both the light source 9 and the second projection lens 14. The condenser lens 10 is a transparent or semitransparent plano-convex lens having a convex-shape light-emitting surface, and is fixed to the bottom plate portion 7*a* ahead of the light source 9 to condense a light B1 by the light source 9 into a focal point F1 on the reflecting surface 15*a*.

The polarized light generator 8 in FIG. 2 is positioned between the condenser lens 10 and the reflecting mirror 15 of the scanning mechanism 13 and on an optical path of the light B1 by the light source 9, and is mounted on the bottom plate portion 7*a* so as to be opposed to both the condenser lens 10 and the first projection lens 12. The polarized light generator 8 has a configuration in which a first polarizer 8*a* and a second polarizer 8*b* are arranged vertically in parallel as illustrated in FIG. 1, and is configured to be displaceable vertically in a back and forth manner with a slide mechanism (not illustrated). The first polarizer 8*a* has an S-polarized light transmitted and reflects a P-polarized light. The second polarizer 8*b* has the P-polarized light transmitted and reflects the P-polarized light. In FIG. 1, the first polarizer 8*a* is positioned on the optical path of the light B1, and the second polarizer 8*b* is positioned at a position off the optical path of the light B1. The second polarizer 8*b* slides upward to the first polarizer 8*a* position to be positioned on the optical path of the light B1, while at the same time, the first polarizer 8*a* comes off the optical path of the light B1. The first and the second polarizers (8*a*, 8*b*) can shift the position on the optical path or off the optical path by this vertical displacement in a back and forth manner. The first and the second polarizers (8*a*, 8*b*) have either one of the S-polarized light or the P-polarized light transmitted toward the scanning mechanism 13 when positioned on the optical path of the light B1, and reflect the other toward the first projection lens 12.

The polarized light generator 8 illustrated in FIG. 2 separates the light B1 into a reflected polarized light B 11 as a first polarized light and a transmitted polarized light B12 as a second polarized light. When the first polarizer 8*a* is positioned on the optical path of the light B11, the reflected polarized light B 11 turns into the P-polarized light and the transmitted polarized light B12 turns into the S-polarized light. On the other hand, when the second polarizer 8*b* is positioned on the optical path of the light B11, the reflected polarized light B11 turns into the S-polarized light and the transmitted polarized light B12 turns into the P-polarized light.

Figure 4:
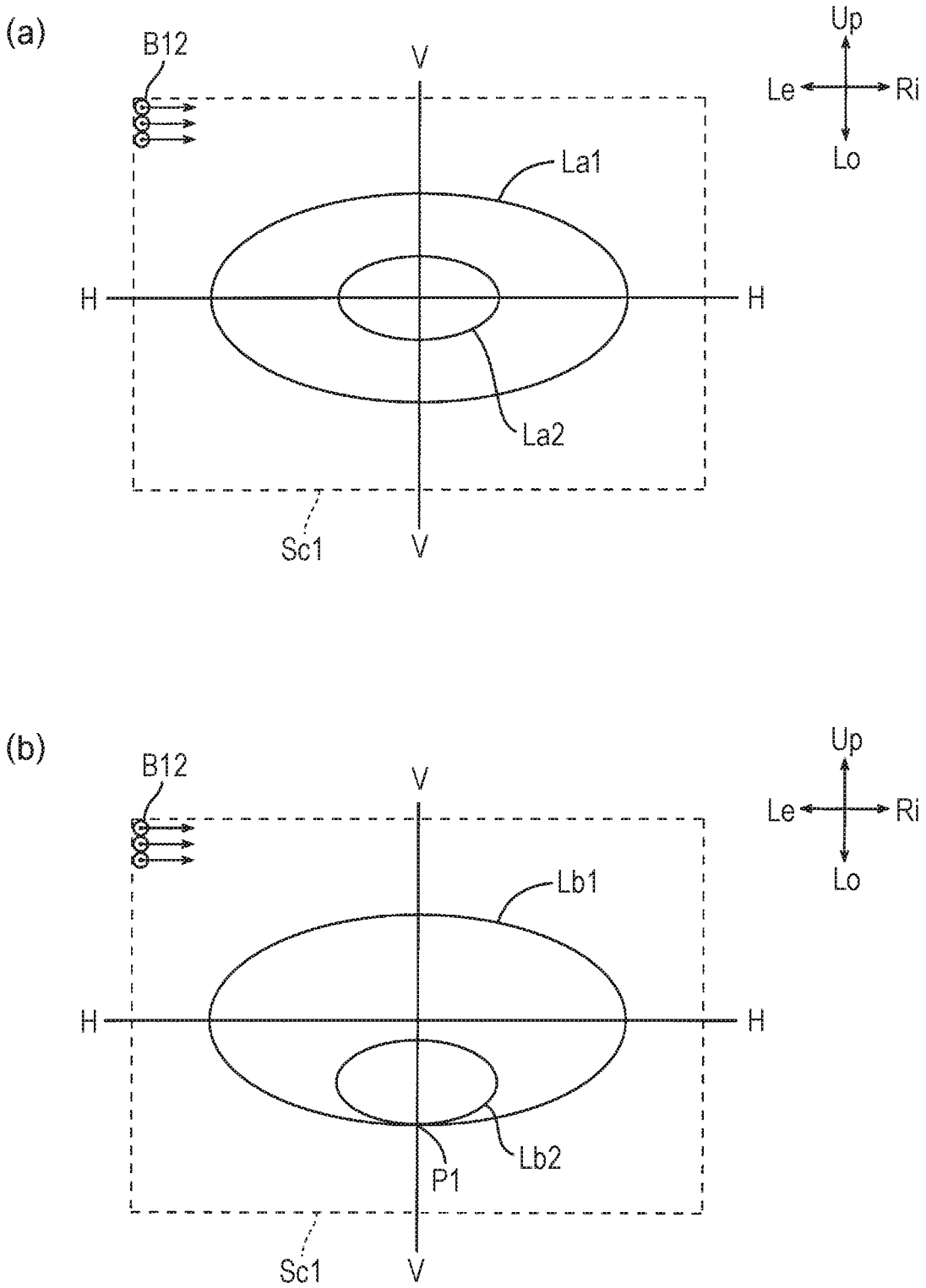
FIG. 4(*a*) is an explanatory diagram of a first light distribution pattern according to respective examples.

As illustrated in FIG. 2, the reflected polarized light B11 is transmitted through the first projection lens 12 and the front cover 3, and indicates main light distribution patterns (L*a*1, L*b*1) illustrated in FIGS. 4(*a*) and 4(*b*) ahead of the vehicle (not illustrated). The first headlight unit 5 utilizes a polarized light component that is not originally utilized by being reflected by the polarized light generator 8 to form a contour of a combined light distribution pattern, leading to improving usage efficiency of the polarized light component.

The shutter 23 in FIG. 2 is fixed to the bottom plate portion 7*a* of the supporting member 7 so as to be located between the polarized light generator 8 and the reflecting mirror 15 and on the optical path of the transmitted polarized light B12 generated by the polarized light generator 8. The shutter 23 is controlled by a control unit (not illustrated) to pass or block the light at a predetermined timing. The headlight unit 4 is tiltably supported with respect to the lamp body 2 by having three aiming screws 24 screwed to the screw fixing portion 7*f* of the base plate portion 7*e* of the supporting member 7. The aiming screws 24 are turnably held to the lamp body 2. Also, the lamp space S is provided inside with an extension reflector 25 screening a peripheral area of the first projection lens 12 and the second projection lens 14 from the front.

Figure 3:
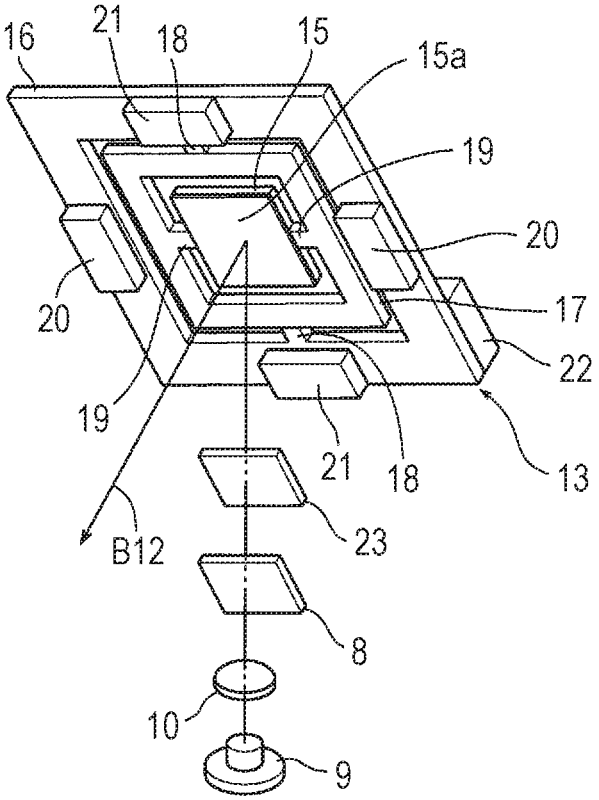
FIG. 3 is a perspective view viewing a scanning mechanism of the first example from an oblique front of a reflecting mirror.

The scanning mechanism 13 illustrated in FIG. 2 has a MEMS mirror and the like, and has the reflecting mirror 15, a base 16, a turning body 17, a pair of first torsion bars 18, a pair of second torsion bars 19, a pair of permanent magnets 20, a pair of permanent magnets 21, and a terminal portion 22, as illustrated in FIG. 3. The reflecting surface 15*a* is formed by performing treatments, such as silver vapor deposition and plating, on a front face of the reflecting mirror 15.

The plate-shaped turning body 17 in FIG. 3 has a first coil (not illustrated) fed with power from the terminal portion 22, and is supported by the base 16 in a state capable of tilting to right and left by the pair of first torsion bars 18. The reflecting mirror 15 has a second coil (not illustrated) fed with power from the terminal portion 22, and is supported by the turning body 17 in a state capable of vertically turning by the pair of second torsion bars 19. The turning body 17 swings and rotates about an axis line of the first torsion bars 18 to right and left in a back and forth manner at high speed with the first coil. Energization of the first coil is controlled by the pair of permanent magnets 20 and its control mechanism (not illustrated). The reflecting mirror 15 also vertically swings and rotates about an axis line of the second torsion bars 19 in a back and forth manner at high speed with the second coil. Energization of the second coil is controlled by the pair of permanent magnets 21 and its control mechanism (not illustrated). The plate-shaped turning body 17 reflects the transmitted polarized light B12 emitted from the light source 9 and transmitted through the polarized light generator 8 toward the second projection lens 14 with the reflecting surface 15*a* while scanning within a range of a scanning area Sc1 in FIGS. 4(*a*) and 4(*b*) a predetermined direction.

The transmitted polarized light B12 illustrated in FIG. 2 is turned on and off to the reflecting mirror 15 of the scanning mechanism 13 based on controlling of the pass or block of the light by the shutter 23. Scanning to right and left at high speed by the reflecting mirror 15 causes the transmitted polarized light B12 to illustrate a bar line having a length extending to right and left based on a light-on/off action at a predetermined position. The bar line illustrated to right and left at high speed at the position and with the length based on the lighting control of the transmitted polarized light B12 is vertically accumulated by repeating the high speed lateral scanning while an elevation angle of the reflecting mirror 15 is shifted in steps of a slight degree. This results in spot-irradiation of predetermined irradiation targets ahead of the vehicle (not illustrated) with auxiliary light distribution patterns (L*a*2, L*b*2) having a range narrower than the main light distribution patterns (L*a*1, illustrated in FIGS. 4(*a*) and 4(*b*).

The main light distribution pattern L*a*1 by the reflected polarized light B11 illustrated in FIG. 4(*a*) widely irradiates a front of the vehicle, and the auxiliary light distribution pattern L*a*2 by the transmitted polarized light B12 irradiates a central region inside the main light distribution pattern L*b*1 to form a hot spot. The auxiliary light distribution pattern L*a*2 where the central region is spot-irradiated irradiates oncoming vehicles, and traffic signs and the like located obliquely upward from the front of the vehicle. The transmitted polarized light B12 indicating the auxiliary light distribution pattern L*a*2 turns into the S-polarized light by positioning the first polarizer 8*a* of the polarized light generator 8 on the optical path of the light B11, and turns into the P-polarized light by sliding the polarized light generator 8 to shift the first polarizer 8*a* to the second polarizer 8*b*.

If the vehicle headlight 1 irradiates a road with the S-polarized light, a driver of a host vehicle easily views shapes of the road ahead. By contrast, if the vehicle headlight 1 irradiates the approaching oncoming vehicles and the traffic signs obliquely upward with the S-polarized light, the driver of the host vehicle sometimes feels brightness of a reflection due to a reflected light. In such a case that irradiation of predetermined irradiation targets, such as the oncoming vehicles and the traffic signs obliquely upward with the P-polarized light, reduces the brightness that the driver feels compared with the S-polarized light, the vehicle headlight 1 can reduce the brightness that the driver of the host vehicle feels by shifting the first polarizer 8*a* to the second polarizer 8*b* to turn the spot-irradiation light to the oncoming vehicles and the like into the P-polarized light. Returning the spot-irradiation light to the S-polarized light by using the first polarizer 8*a* again after the vehicle passes the oncoming vehicles and the like can ensure the visibility of the shape of the road again.

The main light distribution pattern L*b*1 by the reflected polarized light B11 illustrated in FIG. 4(*b*) widely irradiates the front of the vehicle, and the auxiliary light distribution pattern Lb2 by the transmitted polarized light B12 irradiates near a lower end portion P1 inside the main light distribution pattern Lb1 to form a hot spot. A light directed ahead and obliquely downward of the vehicle, when being irradiated to the front of the vehicle and an adjacent damp road surface, sometimes causes the driver of the host vehicle to feel the brightness due to the reflection from the damp road surface.

The S-polarized light is reflected stronger than the P-polarized light when being irradiated on the damp road surface. Thus, the vehicle headlight 1 can reduce the brightness that the driver of the host vehicle receives due to the reflection by shifting the first polarizer 8*a* to the second polarizer 8*b* to spot-irradiate the damp road surface obliquely downward with the P-polarized light. Returning the spot-irradiation light to the S-polarized light by using the first polarizer 8*a* again after the road surface gets dry can ensure the visibility of the shape of the road again.

Thus, the vehicle headlight 1 of this example has an advantage that selects the polarized light irradiated between S and P depending on the irradiation targets, the road dampened surface conditions, and the like, and precisely irradiates the irradiation targets in a predetermined direction, while allowing the driver of the host vehicle to avoid feeling the brightness.

Figure 5:
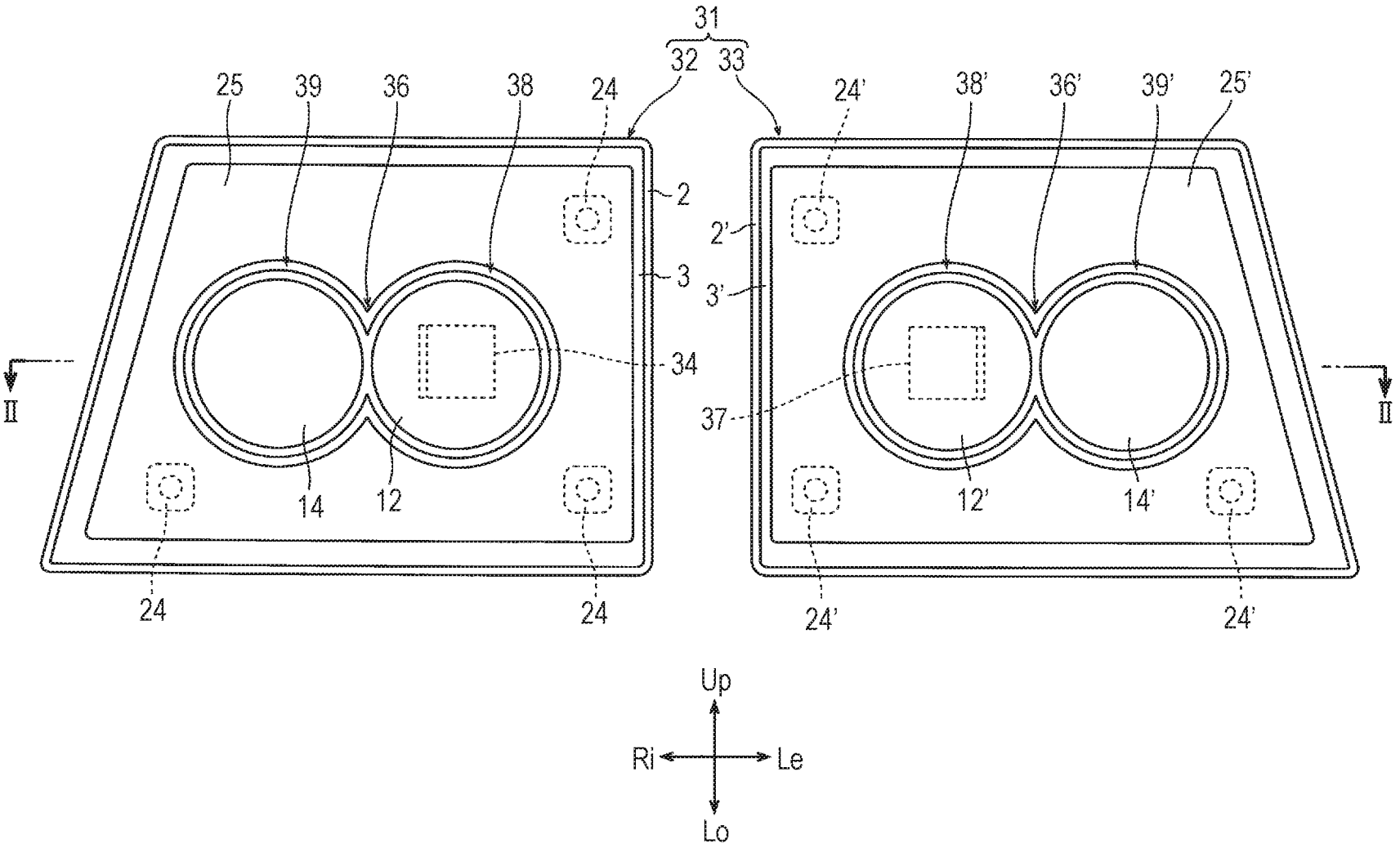
FIG. 5 is a front view of a vehicle headlight according to a second example.
Figure 6:
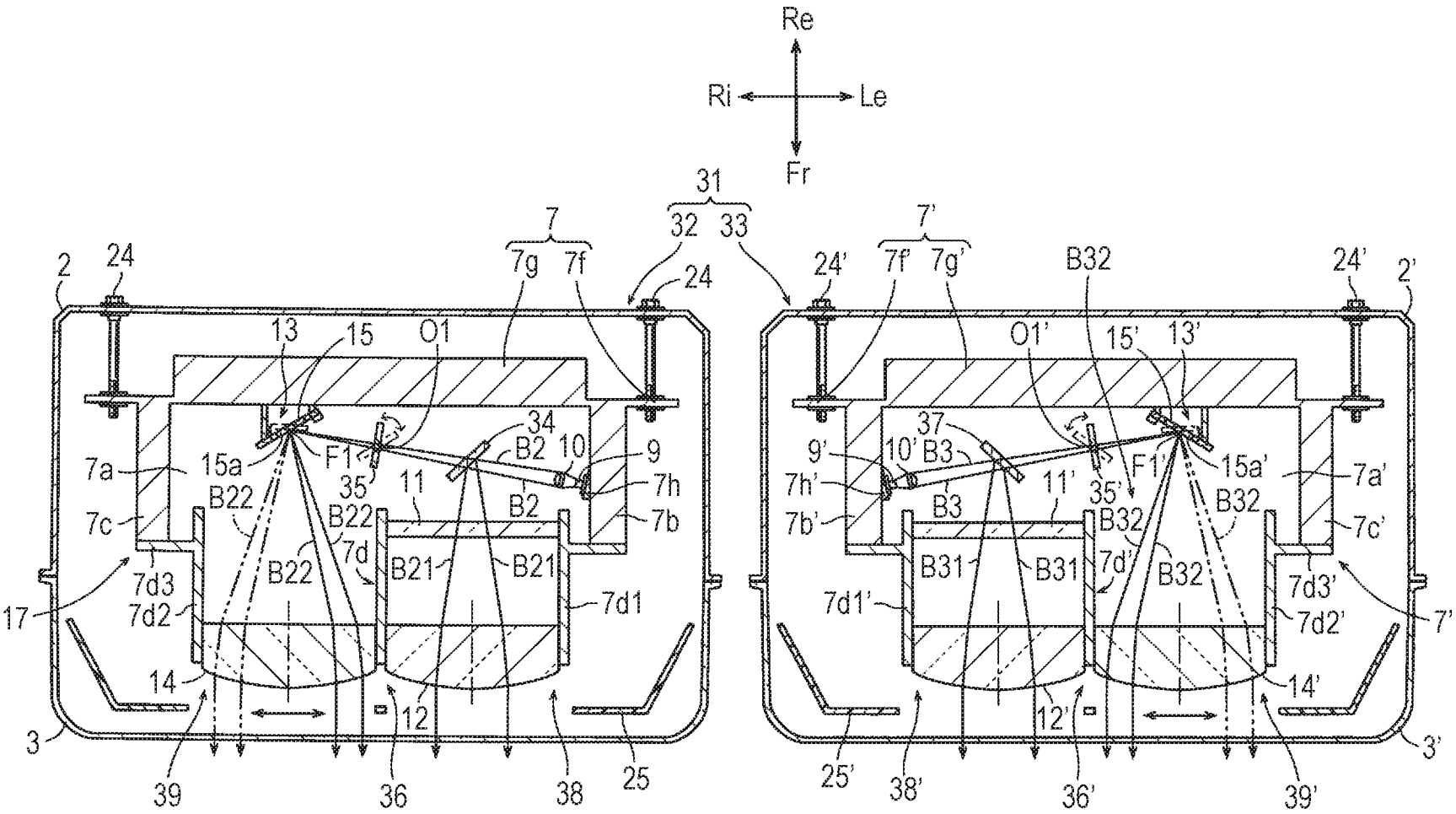
FIG. 6 is a II-II cross-sectional view taken along the lateral direction of the vehicle headlight according to the second example.

Next, the following describes a vehicle headlight 31 of a second example with reference to FIG. 5 and FIG. 6. The vehicle headlight 31 of the second example includes a first headlight 32 on a right side and a second headlight 33 on a left side. The first headlight 32 is provided with a polarized light generator 34 that replaces the polarized light generator 8 in the vehicle headlight 1 of the first example, a transmittance changer 35 as an output changer instead of the shutter 23, and other configurations in common with the vehicle headlight 1 of the first example. The second headlight 33 has a headlight unit 36' configured by symmetrically forming identical components in a headlight unit 36 of the first headlight 32 excluding a polarized light generator 37. Reference numerals of the components in the headlight unit 36' are denoted by adding a prime to the reference numerals of the respective components in the headlight unit 36, excluding the polarized light generator 37.

The polarized light generator 34 of the first headlight 32 illustrated in FIG. 5 and FIG. 6 is a reflection type polarizing plate having only one polarizer that has the S-polarized light transmitted and reflects the P-polarized light. The polarized light generator 34 is positioned between the condenser lens 10 and the reflecting mirror 15 of the scanning mechanism 13 and on an optical path of a light B2 by the light source 9, and is fixed to the bottom plate portion 7*a* so as to be opposed to both the condenser lens 10 and the first projection lens 12. The polarized light generator 34 does not have a switching mechanism of a plurality of polarizers that the polarized light generator 8 of the first example has.

The transmittance changer 35 and a transmittance changer 35' as an output changer illustrated in FIG. 6 are configured to be turnable around axis lines (O1, O1') vertically extending respectively, and are formed of plate-shaped glass polarizers that turn with a driving mechanism controlled by its control unit (not illustrated). The plate-shaped glass polarizers are each positioned in the range of irradiation of a S-polarized light B22 and a P-polarized light B32 between the polarized light generators (34, 37) and reflecting mirrors (15, 15'). The plate-shaped glass polarizers have a part of the S-polarized light B22 and the P-polarized light B32 transmitted in predetermined transmittances based on incident angles, as well as reflecting the remaining lights. The incident angles of the S-polarized light B22 and the P-polarized light B32 with respect to the glass polarizers vary depending on turn and stop positions of the glass polarizers by the control unit (not illustrated). The transmittance changers (35, 35') change the transmittances of the S-polarized light B22 and the P-polarized light B32 respectively, from exceeding 0% to less than or equal to 100%, by rotation controls of the glass polarizers. Note that a position where the transmittance changer 35 is positioned may be anywhere on the optical path of the polarized light B22, which is not limited to the position between the reflecting mirror 15 and the polarized light generator 34. A position where the transmittance changer 35' is positioned may be also anywhere on the optical path of the polarized light B32, which is not limited to the position between the reflecting mirror 15' and the polarized light generator 37.

The polarized light generator 37 of the second headlight 33 illustrated in FIG. 5 and FIG. 6 is formed as a reflection type polarizing plate having only one polarizer that has the P-polarized light transmitted and reflects the S-polarized light, in contrast to the polarized light generator 34. The polarized light generator 37 is positioned between a condenser lens 10' and the reflecting mirror 15' of a scanning mechanism 13' and on an optical path of a light 133 by a light source 9', and fixed to a bottom plate portion 7*a'* so as to be opposed to both the condenser lens 10' and a first projection lens 12'.

The headlight unit 36 of the first headlight 32 in FIG. 5 and FIG. 6 has each of a first headlight unit 38, a second headlight unit 39, the polarized light generator 34 as the reflection type polarizing plate, the light source 9 by a light-emitting element, such as an LED, the condenser lens 10, and the transmittance changer 35. These are all installed to the supporting member 7. The headlight unit 36' of the second headlight has each of a first headlight unit 38', a second headlight unit 39', the polarized light generator 37 as the reflection type polarizing plate, the light source 9' by a light-emitting element, such as an LED, the condenser lens 10', and the transmittance changer 35'. These are all installed to a supporting member 7'. The first headlight units (38, 38') each have liquid crystal panels (11, 11') and the first projection lenses (12, 12'), and the second headlight units (39, 39') each have the scanning mechanisms (13, 13') and the second projection lens (14, 14').

The first headlight unit 38 of the first headlight 32 illustrated in FIG. 5 and FIG. 6 have a P-polarized light B21 transmitted through the liquid crystal panel 11, the first projection lens 12, and the front cover 3 to form the main light distribution patterns (La1, Lb1) illustrated in FIGS. 4(*a*) and 4(*b*). The P-polarized light B21 is a first polarized light in which the light B2 emitted from the light source 9 and transmitted through the condenser lens 10 is entered in the polarized light generator 34 and reflected by the polarized light generator 34. The second headlight unit 39 scans with the S-polarized light B22 and has the S-polarized light B22 transmitted through the second projection lens 14 and the front cover 3 to form the auxiliary light distribution patterns (La2, Lb2) illustrated FIGS. 4(*a*) and 4(*b*) and spot-irradiate predetermined irradiation targets. The S-polarized light B22 is a second polarized light transmitted through the polarized light generator 34.

In FIG. 5 and FIG. 6, the first headlight unit 38' of the second headlight 33 forms the main light distribution patterns (La1, Lb1) illustrated in FIGS. 4(*a*) and 4(*b*) by an S-polarized light B31, in contrast to the first headlight 32. The S-polarized light B31 is a first polarized light generated via polarized light reflection from the light B3 from the light source 9' with the polarized light generator 37. The second headlight unit 39' forms the auxiliary light distribution patterns (La2, Lb2) that scans with the P-polarized light B32 as a second polarized light transmitted through the polarized light generator 37 and spot--irradiates predetermined irradiation targets.

Additionally in FIG. 5 and FIG. 6, the S-polarized light B22 transmitted through the polarized light generator 34 of the first headlight 32 has a light flux density adjusted by being transmitted through the transmittance changer 35 that can change a light transmittance from exceeding 0% to less than or equal to 100%. The P-polarized light B32 transmitted through the polarized light generator 37 of the second headlight 33 has also a light flux density adjusted by being transmitted through the transmittance changer 35' that can change a light transmittance from exceeding 0% to less than or equal to 100%. The S-polarized light B22 and the P-polarized light B32 as the second polarized lights transmitted through the transmittance changers (35, 35') are combined with the respective light flux densities adjusted to form the auxiliary light distribution patterns (La2, Lb2) illustrated in FIGS. 4(*a*) and 4(*b*).

The vehicle headlight 31 in FIG. 5 and FIG. 6 illuminates entirely the front of the vehicle brighter than the first example by generating different reflected polarized lights (the first polarized lights) and transmitted polarized lights (the second polarized lights) in the first headlight 32 and the second headlight 33 to form the combined light distribution pattern, and indicating the main light distribution patterns (La1, Lb1) illustrated in FIGS. 4(*a*) and 4(*b*) with the S+P-polarized light. At the same time, the vehicle headlight 31 freely changes outputs (transmittances) of the S-polarized light B22 and the P-polarized light B32 indicating the auxiliary light distribution patterns (La2, Lb2) with the transmittance changers as the output changers, each in a range from exceeding 0% to less than or equal to 100%, and spot-irradiates the predetermined irradiation targets, such as predetermined oncoming vehicles, the traffic signs obliquely ahead of the vehicle, or the damp road surfaces, with the auxiliary light distribution patterns (La2, Lb2) configured by the combined polarized light of the S-polarized light+the P-polarized light containing the light fluxes in a predetermined proportion, the S-polarized light only, or the P-polarized light only. This can improve visibility of a driver of a host vehicle.

The vehicle headlight 1 of the first example can only shift one of the first polarized light forming the main light distribution patterns (La1, Lb1) and the second polarized light forming the auxiliary light distribution patterns (La2, Lb2) to the S-polarized light, and the other to the P-polarized light. However, the vehicle headlight 31 of the second example can brightly form the main light distribution patterns (La1, Lb1) by combining the S-polarized light+the P-polarized light, and freely change content rates of the light fluxes of the S-polarized light and the P-polarized light included in the light formed by the auxiliary light distribution patterns (La2, Lb2) based on variation of the irradiation targets and change in the road surface conditions. Therefore, the vehicle headlight 31 of the second example has an advantage that allows for the optimal spot irradiation that the driver avoids feeling the brightness by the auxiliary light distribution patterns (La2, Lb2) including the optimal content rates of light fluxes.

This application claims priority from Japanese Patent Application No. 2017-137798 filed with the Japanese Patent Office on Jul. 14, 2017, the entire contents of which are hereby incorporated by reference.

The above description of a specific embodiment of the present invention is disclosed as illustrative. This does not intend to be exhaustive or limit the present invention to the described embodiments as they are. Many modifications and variations will be apparent to one of ordinary skill in the art in light of the above teachings.

LIST OF REFERENCE NUMERALS

1: Vehicle headlight
4: Headlight unit
5: First headlight unit
6: Second headlight unit
8: Polarized light generator
13: Scanning mechanism
31: Vehicle headlight
34: Polarized light generator
37: Polarized light generator
35, 35': Transmittance changer as an output changer
36, 36': Headlight unit
38, 38': First headlight unit
39, 39': Second headlight unit
B1 to B3: Light from a light source
B11, B21, B31: First polarized light
B12, B22, B32: Second polarized light
La1, Lb1: Main light distribution pattern
La1, Lb2: Auxiliary light distribution pattern

What is claimed is:

1. A vehicle headlight having a headlight unit for projecting a light from a light source ahead to form a light distribution pattern, the vehicle headlight comprising:

a polarized light generator that generates a first and a second polarized light by the light from the light source;

a first headlight unit that emits a main light distribution pattern by the first polarized light ahead;

a scanning device comprising a reflecting mirror, the scanning device scanning the second polarized light; and a second headlight unit that emits an auxiliary light distribution pattern that irradiates a range narrower than the main light distribution pattern ahead.

2. A vehicle headlight comprising:

a first headlight comprising:

a first polarized light generator that generates a first and a second polarized light by light from a first light source;

a first headlight unit that emits a first main light distribution pattern by the first polarized light ahead;

a second headlight unit that scans the second polarized light using a first scanning mechanism and emits a first auxiliary light distribution pattern that irradiates a first range narrower than the first main light distribution pattern ahead; and a first output changer that increases and decreases an output of the second polarized light, and a second headlight comprising:

a second polarized light generator that generates a third and a fourth polarized light by light from a second light source;

a third headlight unit that emits a second main light distribution pattern by the third polarized light ahead;

a fourth headlight unit that scans the fourth polarized light using a second scanning mechanism and emits a second auxiliary light distribution pattern that irradiates a second range narrower than the second main light distribution pattern ahead; and a second output changer that increases and decreases an output of the fourth polarized light, wherein the vehicle headlight is configured to combine an S-polarized light emitted by the first output changer and a P-polarized light emitted by the second output changer and to emit a third auxiliary light distribution pattern.

3. The vehicle headlight according to claim 1, wherein the second headlight unit emits the auxiliary light distribution pattern at a center of the main light distribution pattern.

4. The vehicle headlight according to claim 1, wherein the second headlight unit emits the auxiliary light distribution pattern near a lower end portion of the main light distribution pattern.

5. The vehicle headlight according to claim 2, wherein the second headlight unit emits the first auxiliary light distribution pattern at a center of the first main light distribution pattern and the fourth headlight unit emits the second auxiliary light distribution pattern at a center of the second main light distribution pattern.

6. The vehicle headlight according to claim 2, wherein the second headlight unit emits the first auxiliary light distribution pattern near a lower end portion of the first main light distribution pattern and the fourth headlight units emits the second auxiliary light distribution pattern near a lower end portion of the second main light distribution pattern.

* * * * *